US006324881B1

(12) United States Patent
Benedetti et al.

(10) Patent No.: US 6,324,881 B1
(45) Date of Patent: Dec. 4, 2001

(54) METHOD TO CONTROL THE PROFILE OF STRIP IN A ROLLING STAND FOR STRIP AND/OR SHEET

(75) Inventors: Gianpietro Benedetti, Campoformido; Estore Donini, Vimercate; Paolo Bobig, San Canzian d'Isonzo, all of (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 09/660,479

(22) Filed: Sep. 12, 2000

(30) Foreign Application Priority Data

Sep. 14, 1999 (IT) ..... UD99A0168

(51) Int. Cl.[7] ..... B21B 31/07
(52) U.S. Cl. ..... 72/247; 72/252.5; 72/366.2
(58) Field of Search ..... 72/8.9, 9.1, 10.1, 72/11.6, 11.7, 247, 252.5, 366.2

(56) References Cited

U.S. PATENT DOCUMENTS

| | | | | |
|---|---|---|---|---|
| 4,955,221 | * | 9/1990 | Feldman et al. | 72/247 |
| 5,655,397 | * | 8/1997 | Satoh et al. | 72/247 |
| 5,950,478 | * | 9/1999 | Sato et al. | 72/247 |
| 6,119,500 | * | 9/2000 | Ginzburg et al. | 72/247 |

FOREIGN PATENT DOCUMENTS 0049798 4/1982 (EP) .
0249801 12/1987 (EP) .

OTHER PUBLICATIONS

Patent Abstracts of Japan, vol. 012, No. 442, Nov. 21, 1988 & JP 63174709 published Jul. 19, 1988.
Patent Abstracts of Japan, vol. 007, No. 291, Dec. 27, 198 & JP 58163516 published Sep. 28, 1983.
Guo, R. M., "Characteristics of Rolling Mills with Roll Shifting", Iron and Steel Engineer, vol. 65, No. 12, Dec. 1, 1988, pp. 45–54.
Patent Abstracts of Japan, vol. 011, No. 333, Oct. 30, 1987 & JP 62114714 published May 26, 1987.

* cited by examiner

*Primary Examiner*—Ed Tolan
(74) *Attorney, Agent, or Firm*—Stevens, Davis, Miller & Mosher, LLP

(57) ABSTRACT

Method to control the profile of a strip (13) in a rolling stand for strip and/or sheet comprising at least two working rolls, respectively upper **(11*a*) and lower (11*b*) and defining a reference pass-line (15) substantially coinciding with the center line of said strip (13), said rolls (11*a*, 11*b*) defining between them a transit gap (12) through which said strip (13) passes and is rolled and being supported at the ends by respective chocks, said method providing the axial movement (shifting) of said working rolls (11*a*, 11*b*) with respect to said pass-line (15), said working rolls (11*a*, 11*b*) having a shaped surface profile (14) which can be expressed by a polynomial equation, said method providing to apply a first value ("$s_1$") of axial translation, or shifting, to said upper working roll (11*a*) and a second value ("$s_2$") of axial translation, or shifting, to said lower working roll (11*b*)**, $s_1$ being $\neq s_2$.

18 Claims, 2 Drawing Sheets

METHOD TO CONTROL THE PROFILE OF STRIP IN A ROLLING STAND FOR STRIP AND/OR SHEET

FIELD OF THE INVENTION

The invention concerns a method to control the profile of the strip in a rolling stand for strip and/or sheet.

The invention is applied in rolling stands for strip and/or sheet, particularly four-high stands, which provide the axial movement, or shifting, at least of the working rolls.

The invention is applied preferentially in rolling stands where the working rolls have a profile which can be expressed with a cubic equation for at least part of their longitudinal extension.

BACKGROUND OF THE INVENTION

In the state of the art, rolling stands for strip or sheet, particularly four-high stands, use techniques with an axial movement of the rolling rolls.

These techniques serve to ensure a better control of the planarity and profile of the strip and to distribute wear uniformly over the surface of the rolls, particularly to prevent the edges of the strip from acting always in the same zones of the roll surface.

Therefore, in the state of the art, at least the working rolls are subjected to axial translation (shifting) to vary the surface of the roll subjected to the rolling load, so as not to cause areas of most likely wear on the surface of the rolls.

These techniques, adopted for rolls with a plane surface, are widely used and have been thoroughly explored in many applications.

The state of the art also includes rolling rolls with profiles shaped so as to ensure a more precise control of the profile of the strip by means of simple and reliable systems to move the rolls.

To this end there have been proposals for shaped profiles, described by quadratic, cubic, fifth order or polynomial equations in general, which allow to configure a precise control of the strip analytically, defining a specific shifting program, thus obtaining profiles characterized by a desired development more or less rounded.

However, if we use rolls with a surface described by a polynomial curve and where the shifting of the upper roll is the same as and of the opposite sign to that of the lower roll, there is the serious disadvantage that, to obtain a particular profile of the strip, the working rolls must always be in fixed and pre-determined positions.

For example, let us consider the case of working rolls whose profile has an anti-symmetrical cubic development (FIG. 1) which can be described by the equations: $y_1(x)=ax^3+bx+t_h$ and $y_2(x)=ax^3+bx$ respectively for the upper roll and for the lower roll, where $t_h$ represents the value of the gap between the rolls when in a stationary condition.

When the shifting condition is nil, and the median axes of the rolls are substantially aligned, the value of the gap is constant: $t(x)=\text{const}=t_h$.

If the two rolls are offset with respect to each other at the outset, respectively one by the quantity ($x_0$) and the other by the quantity ($-x_0$), the gap function, in a shifting condition of nil, is defined by the equation: $t(x)=y_{g1}(x)-y_{g2}(x)$.

Since $y_{g1}(x)=y_1(x+x_0)=a(x+x_0)^3+b(x-x_0)+t_h$ and $y_{g2}(x)=y_2(x-x_0)=a(x-x_0)^3+b(x-x_0)$, developing the powers and carrying out the calculations we get the equation:

$$t(x)=6ax_0x^2+2ax_0^3+2bx_0+t_h=\alpha x^2+\beta \quad (1)$$

from which it follows that the profile of the gap between two rolls whose profile is described with an anti-symmetrical cubic curve, in conditions where the rolls are initially offset, has a parabolic development.

If we now consider applying a symmetrical shifting to the working rolls, for example of an entity "+s" for the upper roll and "−s" for the lower roll, we have the gap described by the following parabolic equation:

$$t(x)=(6as)x^2+(2as^3+2bs+t_h) \quad (2)$$

For a strip or sheet of a width 2w, the crown, defined as the difference between the gap value in correspondence with the center line of the strip, gap (0), and the value in correspondence with the edge of the strip, gap(w), is thus equal to: $t(x)-t(0)=6asw^2$.

Therefore, for positive shifting values (s>0), the crown will have a convex development (FIG. 2*a*), while for negative shifting values (s<0), the crown will have a concave development (FIG. 2*b*).

Shifting applied to the working rolls in any case causes the gap value to vary in correspondence with the center line:

$$\text{gap}(x=0)=2bs+2as^3+t_h$$

So as not to modify the value of the gap, it is therefore necessary to reposition the two rolls, one with respect to the other, by the quantity $2bs+2as^3$.

This operation is made by repositioning the hydraulic capsules or electromechanical screws which act on the chocks of the rolls by the same height, that is, a value equal to $(2bs+2as^3)$.

From the above, it is obvious how the control of the strip profile is completely rigid if symmetrical shifting of the working rolls is used, that is, if the rolls are translated in the opposite direction with respect to the center line by an equal value "s".

In fact, once a target crown value has been defined with the stand unloaded, that is to say, in a condition wherein no pre-determined bending is imparted to the rolls, it follows that to obtain this target crown value there is only one value of "s", that is, the one defined by the equation s=target crown/$6aw^2$.

This leads to the disadvantage that, in the case where there is a shifting of the upper roll equal in absolute value and of the opposite sign with respect to that of the lower roll, to obtain a particular profile, characterized by a desired crown, the shifting value is univocally determined and with it the position of the working rolls.

This minimizes the benefits of making the wear on the rolls uniform, for which reason shifting is used in the first place.

In fact, by using a bending operation on the working rolls it is possible to obtain a target crown value, that is, a strip profile value, with wider shifting values, that is, there will be a shifting defined by a value "$s+\Delta_1$" for one working roll and "$-s-\Delta_1$" for the other working roll.

The amplitude of the field of variability caused by the shifting operation, and with it the possibility of preventing the edges of the strip from always affecting the same zones of the surface of the rolls, will therefore depend on the available bending value (positive and negative); the higher the bending available, the greater is the possibility of obtaining a target crown in a wide range of shifting values.

This allows to distribute the wear over a wider band of the surface of the rolls, the value of which depends on the value of $\Delta_1$.

Thus, even if using bending makes a rolling process using working rolls having a profile with a cubic or polynomial development more flexible, this in any case does not allow to satisfactorily prevent wear in correspondence with the edges of the strip.

Therefore in any case, especially in hot rolling mills and to obtain thin plane products of high quality, one is obliged to use rolling techniques which solve this problem of wear, for example by rolling strip of a progressively decreasing width to avoid repeated passes in the worn zones of the rolls.

This problem, which still has not been solved and which businessmen working in this field still complain of, considerably limits the possibility of using cubic profiles for working rolls and therefore constitutes a considerable constraint on the development of rolling techniques using rolls with shaped profiles.

The present Applicant has devised and embodied this invention to overcome this shortcoming and to obtain other advantages as explained hereafter.

SUMMARY OF THE INVENTION

The invention is set forth and characterized in the main claim, while the dependent claims describe other innovative characteristics of the main embodiment.

The purpose of the invention is to obtain a method to control the profile of the strip in a rolling stand for strip and/or sheet, which will allow to use rolls with a shaped profile, particularly as described by a cubic equation, or possibly even a polynomial equation of a higher order, solving the problem of foreseen wear in correspondence with the edges of the strip.

In other words, the purpose of the invention is to extend he field of shifting available for the working rolls of a rolling stand for strip/sheet for a given target profile of the strip or sheet to be obtained, to a certain extent making the shifting operation unrelated to how said target profile is obtained, and hence making the system less rigid.

The invention is preferably applied in four-high rolling stands with shaped working rolls whose profile is defined by a curve which can be described with a cubic equation.

In a first characteristic, the invention is embodied in a control method wherein the values of shifting applied to the two working rolls, respectively upper and lower, are not equal.

In other words, the shifting applied to the two rolls is not symmetrical with respect to the center line of the strip defining the pass-line of the stand, assuming for example a value $s_1$ for the upper roll and a value of $s_2 \neq s_1$ for the lower roll.

Using differentiated shifting values for the two working rolls, according to the above, makes the system much less rigid since a target profile of the strip (crown) is no longer characterized by a univocal value of shifting, but by appropriate combinations of two different values which make it much more flexible to adjust and control the position of the rolls.

Using a non-symmetrical shifting, the wear on the surface of the rolls in correspondence with the edges of the strip can be distributed over wider bands, since any extension of the field of variability of the value of $s_1$ (upper roll shifting) is compensated by a corresponding variation in the value of $s_2$ (lower roll shifting).

According to another characteristic of the invention, the control method provides to use a compensation technique which will allow to annul that component which makes the development of the gap, as caused by a differentiated shifting of the two working rolls, non-symmetrical with respect to the center line of the strip.

This non-symmetrical development of the gap, which is an undesired consequence of the non-symmetric shifting of the two working rolls, is compensated by means of a levelling made by actuators which act on the supporting elements of the working rolls and/or the relative back-up rolls.

The actuators may consists of hydraulic capsules, electromechanical screws or other appropriate devices.

The action of the actuators allows to correct the asymmetry of the gap and to return the development thereof to a pre-determined condition of symmetry with a defined and desired value in correspondence with the pass-line of the stand.

With this combined technique of shifting and levelling, therefore, we obtain the advantage of using an asymmetric shifting of the rolls, which allows to distribute the wear of the relative surface over a wider field, without generating asymmetry in the development of the gap and therefore in the profile of the strip. Moreover, these techniques do not entail any modifications to the existing configuration of the stand, since they use devices which are already normally present, and require contrivances and adjustments which can be carried out with maximum precision and reliability.

BRIEF DESCRIPTION OF THE DRAWINGS

The attached Figures are given as a non-restrictive example, and show some preferential embodiments of the invention wherein.

DETAILED DESCRIPTION OF PREFERRED EMBODIMENT

Figure 1:
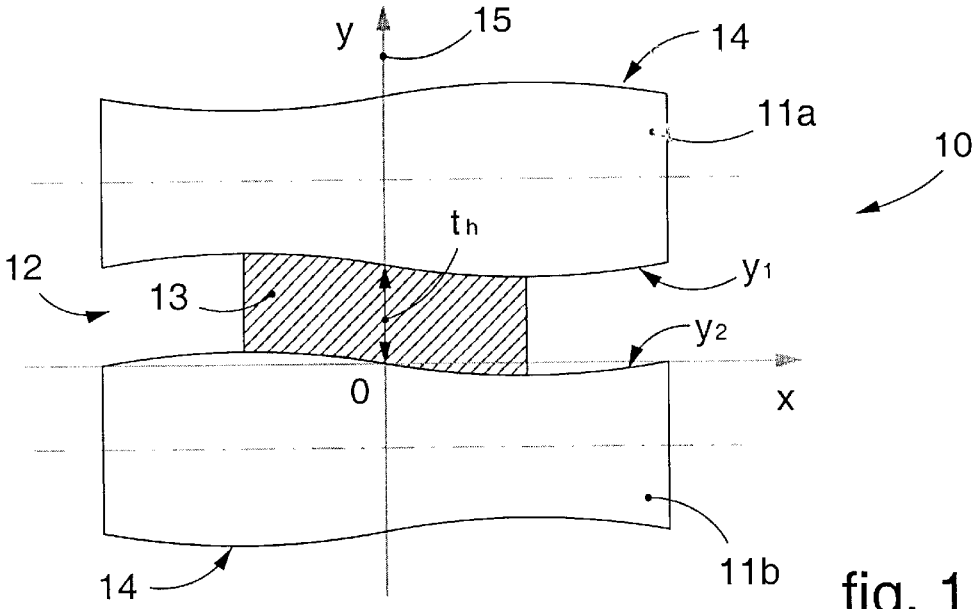
FIG. 1 is a schematic view of the configuration of two conventional working rolls with a profile described by a cubic equation.

In FIG. 1 a rolling stand 10 is schematically represented by its working rolls, upper 11*a* and lower 11*b*, which are arranged with their respective axes parallel and define a transit gap 12 through which the strip 13 passes and is rolled. Strip 13 includes sheet or other type of plane product.

The rolling stand 10 is typically a four-high or six-high stand, and can have back-up rolls 19, respectively upper 19*a* and lower 19*b*, and/or intermediate rolls, which are not shown here.

Figure 4:
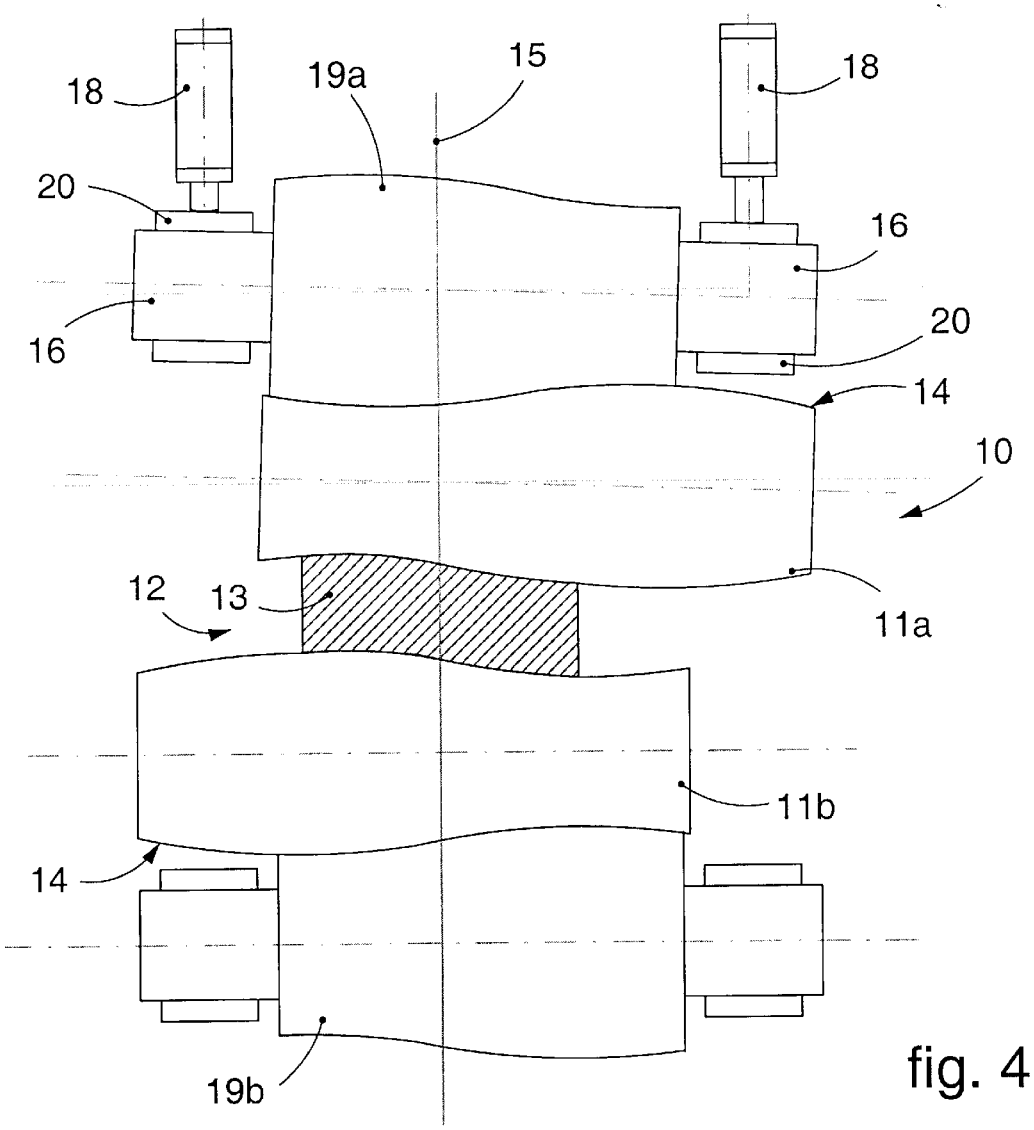
FIG. 4 shows schematically the compensation and levelling technique according to the invention.

The back-up rolls 19 are shown only in FIG. 4 and are supported at the relative ends by chocks 16 which cooperate with bearings 20.

The chocks (not shown) of the working rolls 11*a* and 11*b* and/or the chocks 16 of the back-up rolls 19 are normally associated with hydraulic capsules (not shown) which, when driven in the same direction at two opposite ends of the relative rolls, are suitable to impress a pre-determined bending to the profile of the rolls.

The rolls 11*a* and 11*b* have a shaped profile 14, defined in this case by respective cubic equations with respect to the Cartesian plane x-y which has the intersection between the pass-line 15 of the rolling stand 10 as its origin O, the pass-line 15 normally coinciding with the centerline of the strip 13, and the straight line which defines the theoretical working plane of the lower roll 11*b*.

To be more exact, the profile of the upper roll 11*a* is defined by the equation $y_1(x)=ax^3+bx+t_h$, where $t_h$ represents the value of the gap 12 between the rolls in stationary conditions, while the profile of the lower roll 11*b* is defined by the equation $y_2(x)=ax^3+bx$.

In the stationary and aligned condition as shown in FIG. 1, the gap 12 has a constant value equal to $t_h$.

Figure 2A:
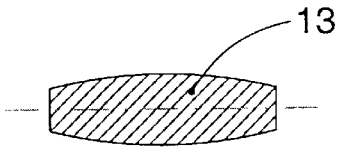
FIGS. 2*a* and 2*b* are schematic views of two possible cases of profiles of a strip respectively convex and concave.
Figure 2B:
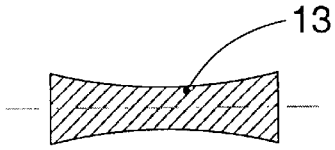

By applying a shifting movement to the rolls 11*a* and 11*b*, that is, translating them laterally in opposite directions with respect to each other and with respect to the strip 13, the equation which describes the gap 12 assumes a parabolic development, thus obtaining specific convex (FIG. 2*a*) or concave (FIG. 2*b*) profiles simply by an axial displacement of the rolls.

Figure 3:
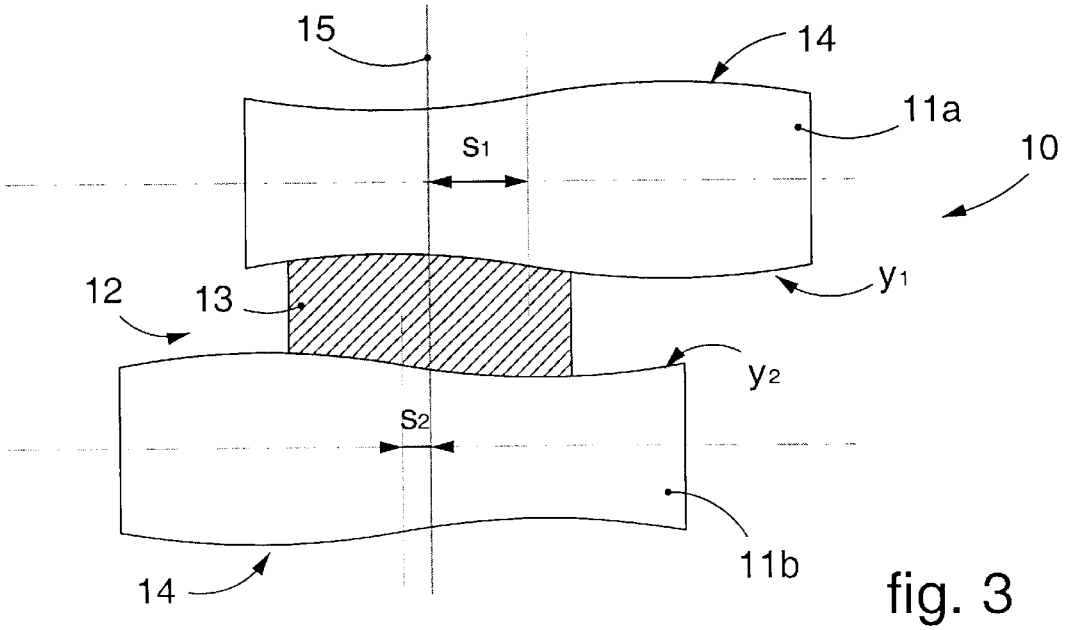
FIG. 3 shows the working rolls of FIG. 2 axially translated in an asymmetric manner according to the method of the invention.

According to the invention, (FIG. 3), the axial shifting applied to the working rolls 11*a* and 11*b* is asymmetric, that is, the upper roll 11*a* is translated with respect to the pass-line 15 by a value $s_1$ which is different from the value of shifting $s_2$ applied to the lower roll 11*b*.

This condition of asymmetric shifting allows to eliminate the univocal nature of the position of the rolls 11*a*, 11*b* to obtain a particular desired profile or crown of the strip 13, since it allows to extend the field of variability of the shifting movement of one of the two rolls by acting on the shifting value of the other roll.

In other words, to obtain a particular profile (crown) of the strip 13, there is no longer one and only one shifting value, as in the case of symmetric shifting, but a plurality of values obtained by combining different values $s_1$ and $s_2$ together.

In fact, so that the strip 13 has a particular crown, the sum of the shifting values $s_1$ and $s_2$ has to assume a defined value, but once the value of the sum has been fixed, there are many combinations of the individual values $s_1$ and $s_2$ to obtain the desired result, once it has been established that $s_1$ and $s_2$ can be different.

This solution eliminates, or at least greatly reduces, the problem arising from the passage of the edges of the strip 13 always on the same zones of the surface of the rolls 11*a* and 11*b* and therefore reduces the problems of wear in said zones, and defective strip quality.

By using these shifting values, we obtain that the equation describing the gap 12 when the rolling stand 10 is in a stationary condition, that is, without any bending or inclination applied to one and/or the other roll 11*a*, 11*b*, is as follows:

$$gap=(y_1-y_2)=[a(x+s_1)^3+b(x+s_1)+t_h]-[a(x-s_2)^3+b(x-s_2)]$$

from which, by developing the powers and making the calculations, we obtain:

$$gap=3ax^2(s_1+s_2)+t_h+b(s_1+s_2)+a(s_1^3+s_2^3)+3ax(s_1+s_2)(s_1-s_2) \quad (3)$$

Figure 5:
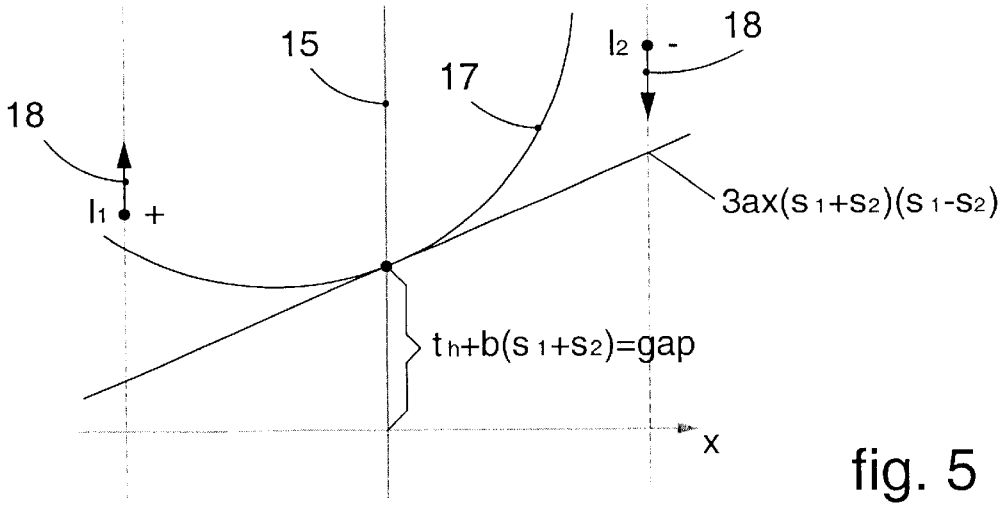
FIG. 5 is a graph to illustrate the compensation and levelling technique as shown in FIG. 4.

This equation represents a parabola, whose coefficients are a function of $s_1$ and $s_2$, not symmetrical with respect to the pass-line 15 of the stand 10; this parabola is shown in FIG. 5 and is indicated by the reference number 17.

The known term $[th+b(s_1+s_2)+a(s_1^3+s_2^3)]$ represents the value of the gap 12 in correspondence with the pass-line 15 of the stand 10.

Since this condition of asymmetry of the development of the gap 12 may be unacceptable since it affects the profile of the strip 13, the invention provides to make a levelling of the stand 10, obtained in this case by acting on actuators 18 associated with the chocks 16 of the upper back-up roll 19*a*.

To be more exact, the levelling is obtained by making a parallel movement of a value equal to $[-b(s_1+s_2)-a(s_1^3+s_2^3)]$, associated with a rotation equal to: $\pm[3ad(s_1+s_2)(s_1-s_2)]$.

In this case (FIG. 4), the levelling is applied only to the upper pair of rolls 11*a* and 19*a* but it is obvious that this action could be made only on the pair of lower rolls 11*b*, 19*b* or on both pairs of rolls.

It also comes within the sphere of the invention to provide that the action of levelling is actuated directly on the working rolls, or on possible intermediate rolls between the working rolls and the back-up rolls.

The actuators 18 may be the electromechanical screws, or the hydraulic capsules which are normally present in the stand 10 and associated with said chocks 16 of the back-up rolls 19. According to a variant, the actuators 18 are specialized for this compensation and levelling function.

As shown schematically in FIG. 4, by driving the actuators arranged on opposite sides of the upper back-up roll 19*a*, it is possible to incline the roll 11*a* maintaining it on the same vertical plane and to obtain a compensation and levelling effect of the stand 10 which annuls the asymmetry of the parabola 17 with respect to the pass-line 15.

FIG. 4 also shows the inclination of upper working roll 11*a*, without bending thereof. Specifically, one actuator 18 through its respective chock 16 applies pressure to one back-up roll 19, thereby causing an inclination or pivoting action to upper working roll 11*a*. Such inclination is shown without bending, because as one actuator 18 forces the end of upper working roll 11*a* downward, the opposite actuator 18 lifts its respective end of working roll 11*a*. It is also understood that such a inclination of lower working roll 11*b*, may be affected much in the same manner. Furthermore, it is also possible to incline both upper working roll 11*a* and lower working roll 11*b*, simultaneously, to achieve variety in the size and shape of gap 12 and the resulting strip 13 profile.

Analytically, with reference to the equation (3) of the gap 12, the inclination displacement of the upper working roll 11*a*, achieved by inclining the corresponding back-up roll 19*a*, must have the following values, respectively for the left side looking at FIGS. 4 and 5 (command side) and for the right side (operator side):

$$l_1=-3ad(s_1+s_2)(s_1-s2)-b(s_1+s_2)-a(s_1^3+s_2^3) \quad l_2=+3ad(s_1+s_2)(s_1-s_2)-b(s_1+s_2)-a(s_1^3+s_2^3).$$

The value d represents the distance between the center line 15 and the point where the rotation is applied, made by the actuators 18 in nil shifting conditions.

By means of this inclination of the roll 11*a*, we restore a parabolic configuration symmetrical to the pass-line 15, for the gap 12, comparable to the stationary configuration as in FIG. 1.

The curve which describes this condition, after levelling, is as follows:

$$gap=3ax^2(s_1+s_2)+t_h$$

from which it can be seen how, in correspondence with the pass-line 15 (x=0) the gap 12 assumes a value equal to $t_h$.

From the above, it can be seen how it is possible to carry out an asymmetrical shifting of the working rolls 11*a* and 11*b* in order to obtain a much more flexible control of the profile of the strip 13, distributing the wear over a wider band of the working rolls 11*a*, 11*b*, and at the same time to level the stand 10 to eliminate the asymmetry of the profile of the gap 12 which this asymmetric shifting entails.

The values of $s_1$ and $s_2$ can have an opposite sign to achieve an opposite shifting with respect to the pass-line 15, or also a concordant sign.

Modifications and variants may be made to this invention, but they shall all come within the scope of the invention as defined in the attached claims.

What is claimed is:

1. A method to control the profile of a strip (13) in a rolling stand for strip and/or sheet comprising at least two working rolls, respectively upper **(11*a*) and lower (11*b*) and defining a reference pass-line (15) substantially coinciding with the center line of said strip (13), said rolls (11*a*, 11*b*) defining between them a transit gap (12) through which said strip (13) passes and is rolled and being supported at the ends by respective chocks, said method providing axial translation of said working rolls (11*a*, 11*b*) with respect to said pass-line (15), said working rolls (11*a*, 11*b*) each having a profile expressed with a cubic equation, the method comprising applying a first value ("$s_1$") of axial translation to said upper working roll (11*a*) and a second value ("$s_2$") of axial translation to said lower working roll (11*b*), $s_1$ being $\neq s_2$, such that said axial translation of said upper working roll and said lower working roll (11*a*, 11*b*) develops a symmetry in said transit gap (12), and compensating and leveling the asymmetry of the development of said transit gap (12) with respect to said pass-line (15) in the presence of said axial movement with different values ($s_1$ and $s_2$) of said upper working roll (11*a*) and said lower roll (11*b*)**.

2. The method as in claim 1, wherein said working rolls **(11*a*, 11*b*) have a profile expressed by a cubic equation of the type $y_1(x)=ax^3+bx$ for said lower roll (11*b*)**.

3. The method as in claim 1, wherein said compensation and leveling step is made by inclining with respect to its own plane at least one of said working rolls **(11*a*, 11*b*) with respect to the other working roll (11*b*, 11*a*)**.

4. The method as in claim 3, wherein said inclination of at least one of the working rolls **(11*a*, 11*b*) is obtained by activating actuators on the respective chocks of said at least one working roll (11*a*, 11*b*)**.

5. The method as in claim 3, applied in a four-high rolling stand which comprises respective back-up rolls **(19*a*, 19*b*) associated with said working rolls (11*a*, 11*b*), wherein said inclination of at least one of the working rolls (11*a*, 11*b*) is obtained by activating actuators (18) which act on the chocks (16) of at least one of said back-up rolls (19*a*, 19*b*)**.

6. The method as in claim 4, wherein said actuators (18) consist of electromechanical screws.

7. The method as in claim 4, wherein said actuators (18) consist of hydraulic capsules.

8. The method as in claim 4, wherein the value of the inclination of said working rolls **(11*a*, 11*b*) is a function at least of the shifting values ("$s_1$") and ("$s_2$") applied and of the shaped profile of said rolls (11*a*, 11*b*)**.

9. The method as in claim 1, wherein said shifting values ("$s_1$") and ("$s_2$") have opposite signs from each other.

10. The method as in claim 1, wherein said shifting values ("$s_1$") and ("$s_2$") have the same sign as each other.

11. The method as in claim 1, characterized in that said rolling stand (10) is a six-high stand.

12. The method of controlling a strip (13) as in claim 1, wherein said cubic equation for said profile of said upper roll **(11*a*) is expressed by $y_1(x)=ax^3+bx+t_h$ and said cubic equation for said profile of said lower roll (11*b*)** is expressed by $y_2(x)=ax^3+bx$.

13. The method of controlling a strip (13) as in claim 1, wherein $s_1$ and $s_2$ are both non-zero.

14. The method of controlling a strip (13) as in claim 5, wherein said actuators comprise electromechanical screws.

15. The method of controlling the profile of a strip (13) of claim 1, wherein said compensating and leveling comprises inclining without bending at least one working roll **(11*a*, 11*b*)**.

16. A device for controlling the profile of a strip (13) in a rolling stand for strip and/or sheet comprising:

at least two working rolls, including an upper **(11*a*) and a lower (11*b*)** rolls;

said at least two working rolls each having a profile defined by a cubic polynomial equation, and adapted to move axially independently of said other at least two working rolls;

a reference pass-line (15) defined by said upper and lower rolls **(11*a*, 11*b*); substantially coinciding with the center line of said strip (13), from which said at least two working rolls are adapted to be shifted, said rolls (11*a*, 11*b*) positioned to define a transit gap (12)** therebetween;

means for applying a first value ("s1") of axial translation to said upper working roll **(11*a*) and a second value ("s2") of axial translation to said lower working roll (11*b*), $s_1$ being $\neq s_2$, such that said axial translation of said upper working roll and said lower working roll (11*a*, 11*b*) develops asymmetry in said transit gap (12); and means for compensating and leveling the asymmetry of the development of said transit gap (12) with respect to said pass-line (15) in the presence of said axial movement with different values ($s_1$ and $s_2$) of said upper working roll (11*a*) and said lower roll (11*b*)**.

17. The device for controlling the profile of a strip (13) of claim 16, wherein said compensating and leveling means comprises actuators in the form of electromechanical screws.

18. The device for controlling the profile of a strip (13) of claim 16, wherein said compensating and leveling means comprises actuators adapted to incline at least one of said working rolls **(11*a*, 11*b*)** without bending thereof.

* * * * *